United States Patent [19]

Bennett

[11] Patent Number: 4,953,767

[45] Date of Patent: Sep. 4, 1990

[54] HOLSTER MOUNTING PLATFORM

[76] Inventor: Christopher E. Bennett, P.O. Box 8226, Raleigh, N.C. 27611-8226

[21] Appl. No.: 430,671

[22] Filed: Oct. 31, 1989

[51] Int. Cl.[5] ..... F41C 33/02; A45F 5/00

[52] U.S. Cl. ..... 224/192; 224/198; 224/243; 224/253; 224/267; 224/904; 224/907

[58] Field of Search ..... 224/907, 912, 911, 253, 224/222, 267, 193, 191, 192, 194, 195, 197, 198, 226, 252, 272, 224, 225, 149, 232, 239, 242, 243, 249, 904, 908, 182, 238, 240, 262, 200, 211, 241, 212, 268, 228, 269, 913, 914, 922; 24/300; 119/96

[56] References Cited

U.S. PATENT DOCUMENTS 4,750,656 6/1988 Bianchi et al. ..... 224/911

4,828,154 5/1989 Clifton ..... 224/912

*Primary Examiner*—Henry J. Recla
*Assistant Examiner*—David J. Walczak
*Attorney, Agent, or Firm*—Kimble, MacMichael & Upton

[57] ABSTRACT

A adjustable holder mounting platform attachable to the waste belt of the wearer for use on either leg, and designed to accommodate a wide variety of handgun holsters. The mounting platform is horizontally and vertically adjustable so that virtually any handgun holster may be placed in an optimum position for the user. The belt mountable faceplate and the platform itself are connected to a disk which provides a pivot around which the platform may rotate, giving the users legs freedom of movement while he or she walks.

7 Claims, 3 Drawing Sheets

HOLSTER MOUNTING PLATFORM

BACKGROUND OF THE INVENTION

1. Field of the Invention

The present invention relates to a mounting assembly designed to hold a wide variety of holsters. The mounting assembly may be anchored to the wearer's waist belt and strapped to either of the wearer's legs.

2. Description of the Prior Art

Handguns are available in a wide variety of sizes and shapes. In the same way, the holsters used to carry handguns are also available in a wide variety of sizes and shapes. In many cases, the holster and belt assembly sold with the handgun cannot be worn comfortably by the user, or does not allow the handgun to be placed in an optimum position on the user's body. These problems may result from improper belt sizes, improper placement of belts, or other design flaws of the holster and belt assembly.

For the user who desires the ability to use a variety of handguns from waist mounted holsters, the different placement of the separate holster required by each handgun makes it impossible for the user to draw and fire each handgun with a consistent movement.

Several holster mechanisms are disclosed in the prior art, none of which directly address this problem.

U.S. Pat. No. 3,252,638 (Rolston, et al.) describes a reversible left and right hand holster with a specially designed pistol pouch. However, this holster is limited to use of the single pistol pouch, and provides very little flexibility in terms of adjusting the horizontal and vertical location of the weapon on the user's leg.

U.S. Pat. No. 4,258,871 (McMahon) describes a holster assembly for handguns which also includes a specially adapted holster body having "Velcro" strips and snaps located thereon for engaging the holster body to the support means.

U.S. Pat. No. 4,205,768 (Hill, et al.) describes a gun belt and holster mounting mechanism which is tailored for use with a specialized "boot" holster which is attached by screws and snaps. This specialized boot may be adjusted, but it cannot be replaced by other holster means for use with different handguns.

U.S. Pat. No. 4,294,385 (Rogers) describes a holster and belt combination in which the pins used to attach the holster allow it to be quickly removed from the belt. However, the holster is not adjustable, and must be fitted with the pin locking mechanisms at specific locations in order to function properly.

The prior art known to the applicant describes holster mounting mechanisms which are designed for a use with specific holsters, none of which allow for free interchangeability of various holsters for use in the same mounting mechanism. Furthermore, none of the prior art discloses a holster mounting mechanism having the great range of horizontal and vertical adjustment flexibility provided by the instant invention.

SUMMARY OF THE INVENTION

The present invention provides an adjustable holster mounting platform for attachment to the waist belt in either leg of the user.

The principal object of the present invention is to provide a holster mounting platform that is not restricted to any particular holster, but which will accommodate virtually any separately manufactured handgun holster.

It is a further object of the present invention to provide a waist belt supported holster mounting platform for use on either the right or left leg of the user.

It is a further object of the present invention to provide a holster mounting platform the position of which may be easily adjusted both horizontally and vertically on the leg of the user.

It is a further object of the present invention to provide an upper attachment faceplate and a lower holster-mounting platform connected by a disc so that the platform may rotate on the disc as the user walks.

Other objects and advantageous features of the invention will be apparent from the description in the claims.

No attempt is made to show structural details of the invention in more detail than is necessary for fundamental understanding of the invention, the description taken with the drawings making it apparent to those skilled in the art how the several forms of the invention may be embodied in practice.

DETAILED DESCRIPTION OF THE DRAWINGS

Figure 1:
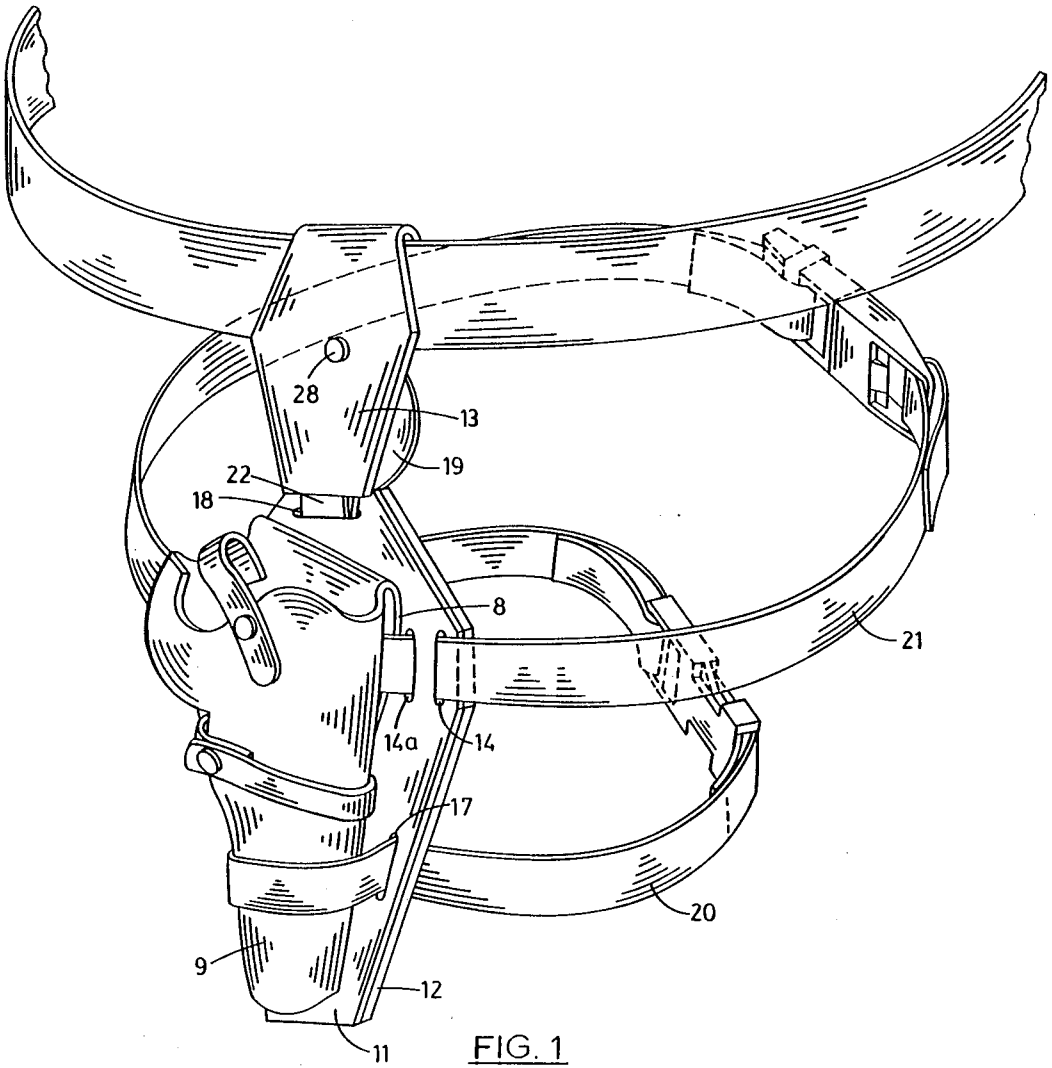
FIG. 1 is a perspective view of one embodiment of the present invention.
Figure 4:
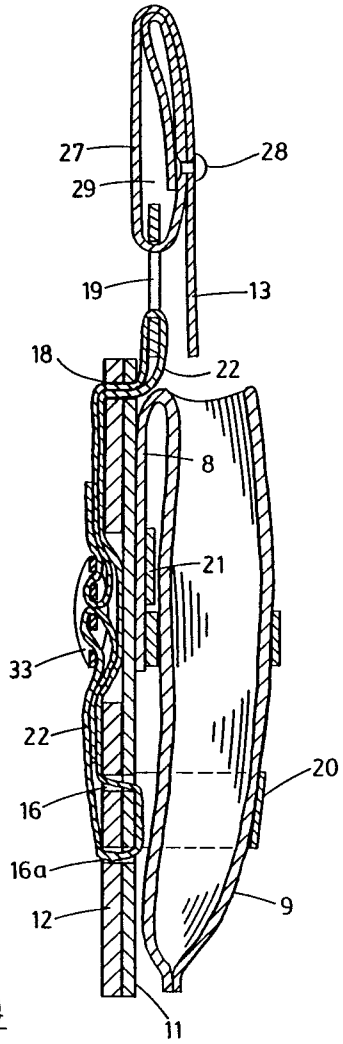
FIG. 4 is a cross sectional view of the invention.

Referring to the drawings wherein like reference characters designate like or corresponding parts throughout the several views, and referring particularly to FIG. 1, it is seen that the invention comprises a hexagonal shaped leather front plate 11 attached to a identically shaped wood back plate 12 to form the main holster-mounting platform. Several long narrow holes (slots) are cut into the platform to accommodate the various mounting belts. Lower mounting belt 20 passes from the back of the platform through slot 17*a*, across the front of the platform and then through slot 17 to the back of the platform. Upper mounting belt 21 passes from the front of the platform into slot 15 to the back of the platform where it engages securing mechanism 31. Thereafter, belt 21 passes again to the front of the platform through slot 15*a*. Similarly, belt 21 passes from the front of the platform through slot 14*a* across securing mechanism 32 and again to the front of the platform through slot 14.

Vertical strap 22 stretches upward from adjusting means 33 and to the front of the platform 11 through horizontal slot 18, through disk 19 and reenters slot 18 to the back of the platform 12 and reemerges to the front at slot 16 where it passes under belt 20 and back through slot 16*a* to the back of the platform where it again stretches upward through adjusting means 33. Strap 22 also engages upper faceplate 13 through disc 19.

Buckling means 25 and 26 are found on either end of belt 21, and buckling means 23 and 24 are found on either end of belt 20.

A fold over flap 27 is located at the upper end of faceplate 13 and is attached to the back of faceplate 13 by means 28 so as to allow a gap 29 through which disc 19 may pass. Virtually any holster 9 having a back flap 8 can be mounted on the platform so provided.

In operation, the waist belt of the user is removed and passed through gap 29 of upper faceplate 13 as seen in FIG. 1. This provides the anchoring support for the entire holster mounting platform. Belt 22 may then be adjusted vertically so as to position platform 11 at the optimum location for easy reach by the user. Adjustment means 33 is used to take up any excess slack in belt 22 once the optimum vertical location of the platform has been selected. Disc 19 provides the main pivot between the faceplate 13 and the platform 11. As the user walks, belt 22 and flap 27 slide along disc 19 to allow freedom of movement between the two platforms.

Upper belt 21 is designed to be fastened around the leg of the user and through back flap 8 of the holster itself. Adjustment means 31 and 32 may be cinched up to take up any excess slack in belt 21 so that the holster may be firmly attached to the platform.

Figure 2:
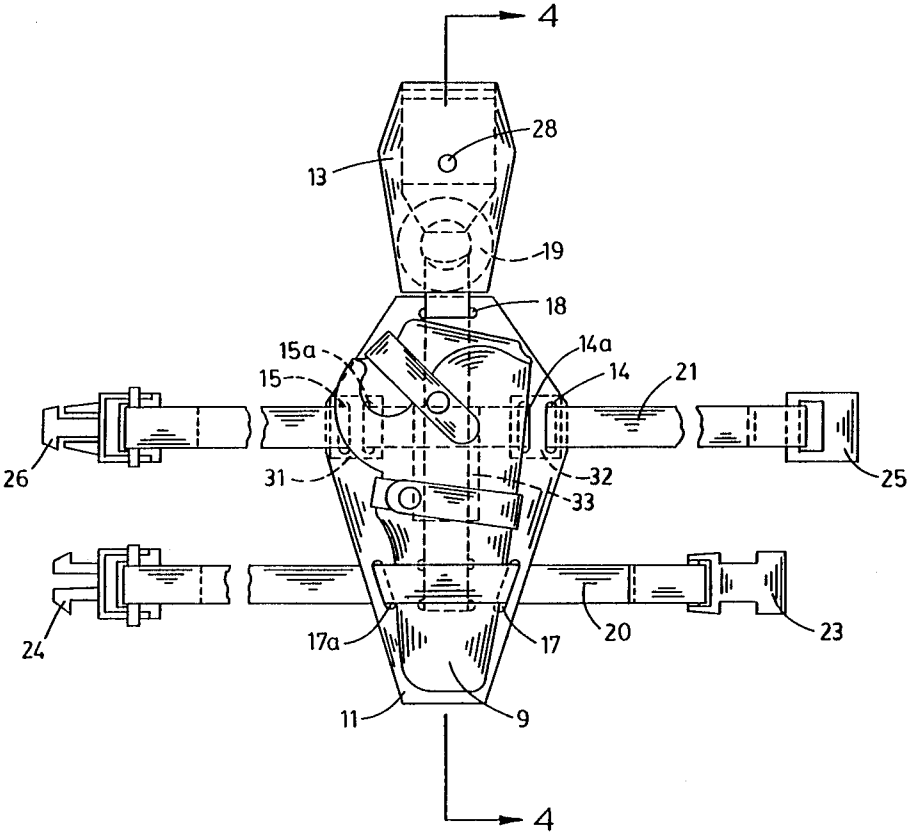
FIG. 2 is an outside view of the invention.
Figure 3:
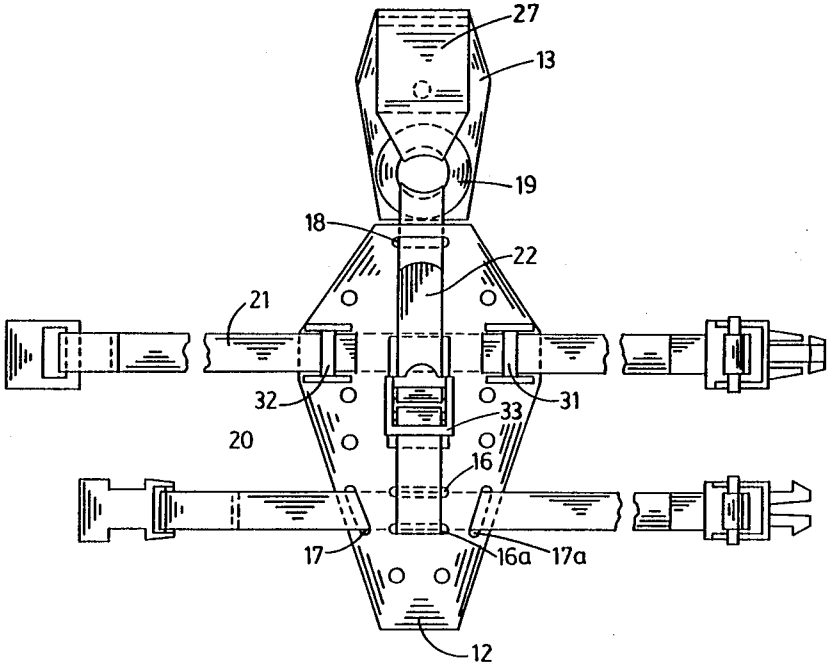
FIG. 3 is an inside view of the invention.

Lower belt 20 is also designed to fit around the leg of the user. A portion of belt 20 is threaded through slots 17 and 17*a* so as to cause a pocket to be formed which holds the lower end of the user's holster 9 as seen in FIG. 1 and FIG. 2. Belt 20 may then be tightened around both the holster and the leg of the user.

If the holster 9 has no back flap 8, a pair of slots may be cut into the back of the holster to allow belt 21 to pass through in order to hold the top portion of the holster snugly against the platform. If there is neither a back flap nor slots in the holster itself, belt 21 may be wrapped around the upper portion of the holster in the same manner as belt 20 is wrapped around the lower end of the holster. Cinching means 31 and 32 may then be employed to tighten the holster against the platform. Longitudinal adjustment of the location of the holster may be accomplished by tightening, loosening and otherwise adjusting straps 20 and 21 on the user's leg.

DESCRIPTION OF THE PREFERRED EMBODIMENTS

In the preferred embodiment, the platform is constructed of a wooden backplate 12 and a leather frontplate 11. Horizontal belts 20 and 21 as well as vertical strap 22 may be made of nylon or other suitable durable material such as leather. However, leather suffers from the drawback of shrinkage if it becomes very wet. The disk 19 can be made of metal or an extremely durable plastic material. A nylon vertical strap 22 slides more easily on a metal disk 19 than a leather strap on the plastic disk.

If a holster is also provided, it should be of the type depicted in FIG. 1 having a fold over flap 8 through which belt 21 may pass. Alternative holsters may have a pair of vertical slots cut into them so that belt 21 may pass into and out of the holster. However, threading belt 21 into the holster may interrupt smooth removal of the handgun. Belt 21 should therefore be of sufficient length to go around not only the user's leg but also the upper portion of the holster and through cinching means 31 and 32 so as to allow sufficient length to not only fit around the user's leg, but also firmly attach the holster to the platform.

By appropriate adjustment of the various belts and straps, the invention may be placed in an ideal location on the user's leg for easy access. Disk 19 makes it possible for the user to walk, run, ride, or otherwise bend his or her leg with relative freedom of movement. The entire invention is designed symmetrically around a central axis so that it may be used on either leg by placing therein an either righthanded or lefthanded holster.

While this invention has been described with a certain degree of particularity, it is manifest that many changes may be made in the details of construction and the arrangement of component parts without departing from the spirit and scope of the disclosure. It is understood that the invention is not limited to the embodiment set forth herein for purposes of exemplification, but is limited only by the scope of the attached claim or claims, including the full range of equivalency to which each claim thereof is entitled.

I claim:

1. A handgun holster mounting platform for mounting a holster to a leg of a user, comprising:

(a) a lower mounting platform sized and adapted to receive a handgun holster thereon having a plurality of horizontal and vertical slots located therein;

(b) an upper faceplate having folded over flap at the upper portion thereof defining a loop through which a user's waist belt may be threaded;

(c) a disc means having an aperture therethrough, said loop loosely passing through said aperture;

(d) a strap means for adjustably connecting the upper faceplate to the lower platform by threading said strap through said aperture of said disc means and through not less than two horizontal slots located in said lower mounting platform;

(e) an upper mounting belt sized to fit around a leg of a user and adjustably threaded through not less than four upper vertical slots located in the lower mounting platform;

(f) a lower mounting belt sized to fit around a leg of a user and adjustably threaded through not less than two lower vertical slots located in the lower mounting platform;

(g) buckling means located at the ends of said upper mounting belt;

(h) buckling means located at the ends of said lower mounting belt; and whereby said upper and lower mounting belts cooperate with a handgun holster to secure a handgun holster to said mounting platform and to a leg of a user.

2. The holster mounting platform described in claim 1 wherein a pair of cinching means is provided along the upper mounting belt on the back side of the platform between the slots through which said belt is threaded into said platform.

3. The holster-mounting platform described in claim 2 wherein an adjustment means is provided on said strap means at the back of said lower mounting platform to allow vertical adjustment of the platform on the leg of the user with respect to the position of the disc.

4. The mounting platform described in claim 3 wherein the lower platform is comprised of an outer leather surface and an inner wood surface through which identical sets of slots are cut.

5. The mounting platform described in claim 4 wherein a handgun holster is provided, such holster, having a fold over flap through which said upper mounting belt is threaded in order to secure said holster against said lower mounting platform.

6. The mounting platform described in claim 4 wherein a handgun holster is provided having a pair of vertical slots cut therein through which said upper mounting belt is threaded in order to secure said holster against said lower mounting platform.

7. The holster mounting platform described in claim 4, wherein the construction is symmetrical so that it may be mounted on either the right leg or the left leg of the user.

* * * * *